United States Patent [19]

Hurd

[11] 4,023,385

[45] May 17, 1977

[54] OSCILLATING VALVE FOR JET DYE BECK

[75] Inventor: Audrey Grant Hurd, Pulaski, Va.

[73] Assignee: Burlington Industries, Inc., Greensboro, N.C.

[22] Filed: Sept. 2, 1975

[21] Appl. No.: 609,814

[52] U.S. Cl. ..... 68/62; 68/178; 68/184

[51] Int. Cl.[2] ..... D06B 3/28

[58] Field of Search ..... 68/15, 177, 178, 184, 68/62

[56] References Cited

UNITED STATES PATENTS

| | | | |
|---|---|---|---|
| 3,330,134 | 7/1967 | Carpenter | 68/178 X |
| 3,587,256 | 6/1971 | Spara | 68/177 |
| 3,686,905 | 8/1972 | Stanway | 68/177 X |

*Primary Examiner*—Philip H. Coe
*Attorney, Agent, or Firm*—Cushman, Darby & Cushman

[57] ABSTRACT

A doffing jet for use in jet dyeing machines to plait fabrics being dyed therein. The doffing jet is placed adjacent the area where the fabric discharged from the jet enters the kier of the jet dyeing machine and is operated by having a supply of dyestuff supplied to the jet in an oscillating or pulsating fashion with the periods of liquid flow being with a force sufficient to move the cloth toward the outer wall of the kier.

14 Claims, 8 Drawing Figures

Fig. 5.
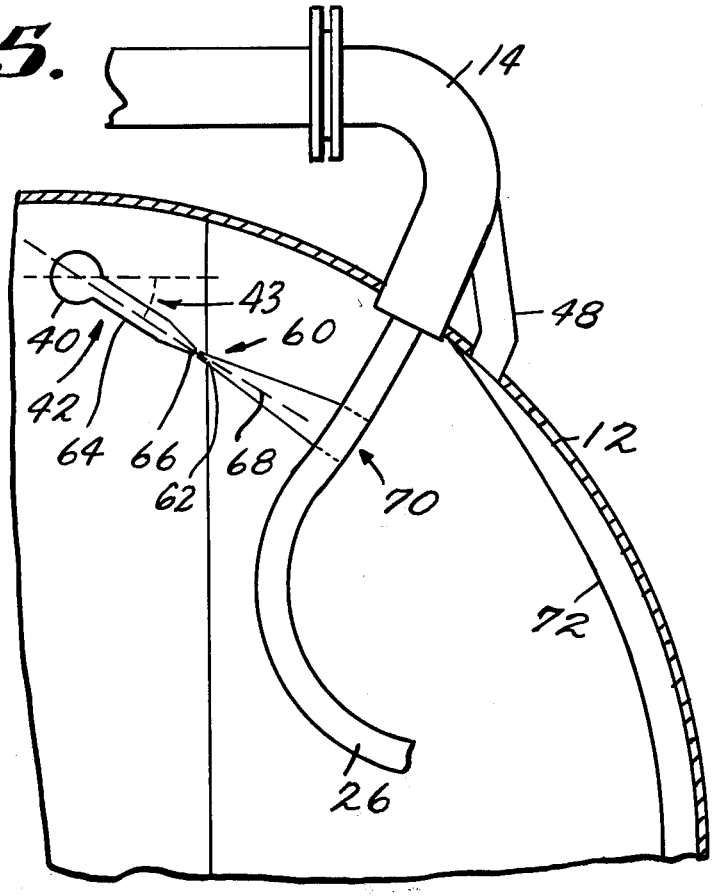
Fig. 4a.
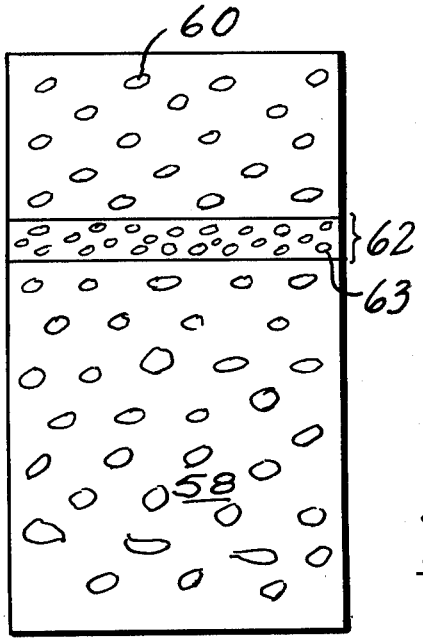
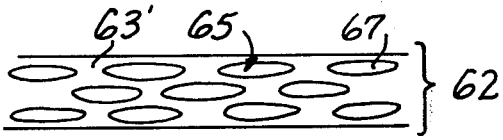
Fig. 4b.
Fig. 7.
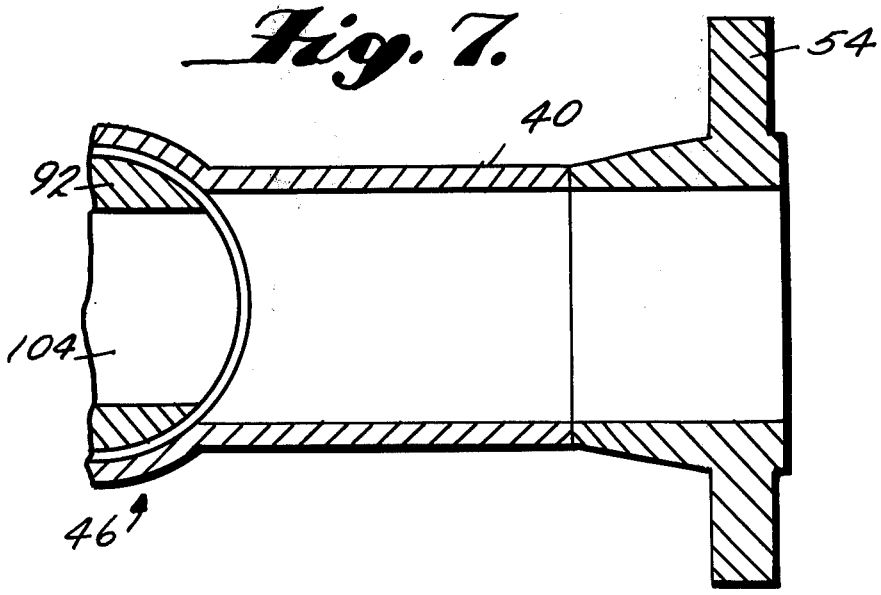

OSCILLATING VALVE FOR JET DYE BECK

A number of patents have issued that deal with jet dyeing machines, the earliest being U.S. Pat. No. 2,978,291, which is commonly referred to as the Fahringer Jet Dyeing Machine Patent. That patent related to a novel method and apparatus for treating cloth or other textile materials such as with a dyestuff when the cloth being treated was moved through the apparatus by means of a jet.

Representative patents of other dyeing machines found in the United States are U.S. Pat. Nos. 3,330,134; 3,511,068; 3,587,256 and 3,780,544.

In most of the jet dyeing machines that have been developed since the Fahringer patent, the fabric is moved from the storage portion or kier of the jet dyeing machine, passed through the jet and then back into the kier.

In order that the fabric not become tangled, and to insure smooth and even running operating conditions, it is important that the fabric being placed back into the kier subsequent to its passage through the jet is in a regular pattern. Usually, the cloth is folded back and forth and this process of folding the cloth is referred to as plaiting.

There have been a variety of techniques for trying to accomplish plaiting in jet dyeing machines. One such patent which employs the use of a continuous or intermittent jet is Thies, U.S. Pat. No. 3,670,531. Thies shows the use of an injection nozzle which is used in conjunction with a deflection device to apparently cause plaiting to occur as the fabric is returned to the kier. Thies does not, however, discuss plaiting light-weight fabrics. Neither does it recognize the problems associated with such fabrics nor how to operate the injection nozzle.

U.S. Pat No. 3,780,544 to Turner discloses the use of a baffle member 50 to effect the orderly piling or plaiting of fabric and that the use of this baffle member can allow operating speeds to be increased up to 300 yards per minute.

Another known device consists of a doffing jet which is placed below the cloth guide tube and is used to separate the cloth from the conveying fluid following its passage through the jet and which also serves to remove entrapped air. This known doffing jet extends through the perforated inner wall of the vessel and is operated so as to plait the cloth as it returns into the kier.

Applicant is also aware of defensive publication No. T814,213 which relates to a valve for producing pressurized fluid pulses. Specifically, the apparatus described in that publication employs a rotating central hub for distributing an airstream to a plurality of pipes so as to deflect in a controlled manner filaments emerging from a forwarding jet. The valve produces sonic pulses of air by using outlet ports of a particular shape and size such that the flow through the orifice will be at sonic velocities notwithstanding the degree of openness between the outlet pipe and the port.

Another known method of plaiting is disclosed in Christ et al., U.S. Pat. No. 3,679,357 which uses alternating sources of suction to pull dye liquor away from the entrance area of the kier. As the dye liquor is alternately pulled toward one side of the entrance and then the other, the cloth moves with the dye liquor and will thus be folded.

With regard to all of the jet devices described above, none has recognized difficulties that arise when light or relatively light-weight fabrics are being dyed.

Applicant has found that notwithstanding the particular type of plaiting devices previously used or supplied with jet dyeing machines, light-weight or relatively light-weight fabrics present special handling problems that the plaiting devices heretofore contemplated did not deal with effectively. The light-weight or relatively light-weight fabric referred to herein concerns fabric weighing 10–20 lbs./100 yds. In particular, when dyeing light-weight fabrics, it has been very difficult to obtain fabric circulation rates normally associated with heavier weight fabrics such as worsted, polyester-wool blends, or knit fabrics.

Therefore, it is a primary object of this invention to provide an improved apparatus for effectively causing the plaiting of light-weight textile products upon their entry into the kier of a jet dyeing machine following their passage through the jet.

It is another object of the present invention to provide an improved apparatus for greatly increasing the amount of light-weight fabric that can be dyed.

With these and other objects in view, which will become apparent in the following detailed description, the present invention, which is shown by example only, will be clearly understood in connection with the accompanying drawings in which.

Figure 3:
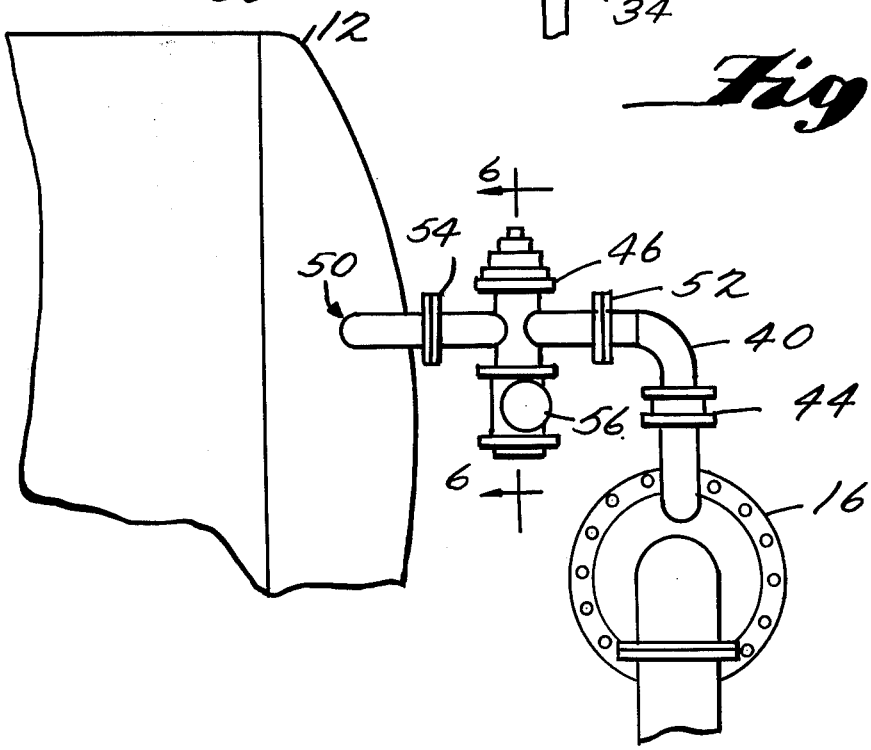
FIG. 3 shows a plan view showing the mounting of the oscillating valve with respect to the kier of the jet dyeing machine and the heat exchanger.
Figure 6:
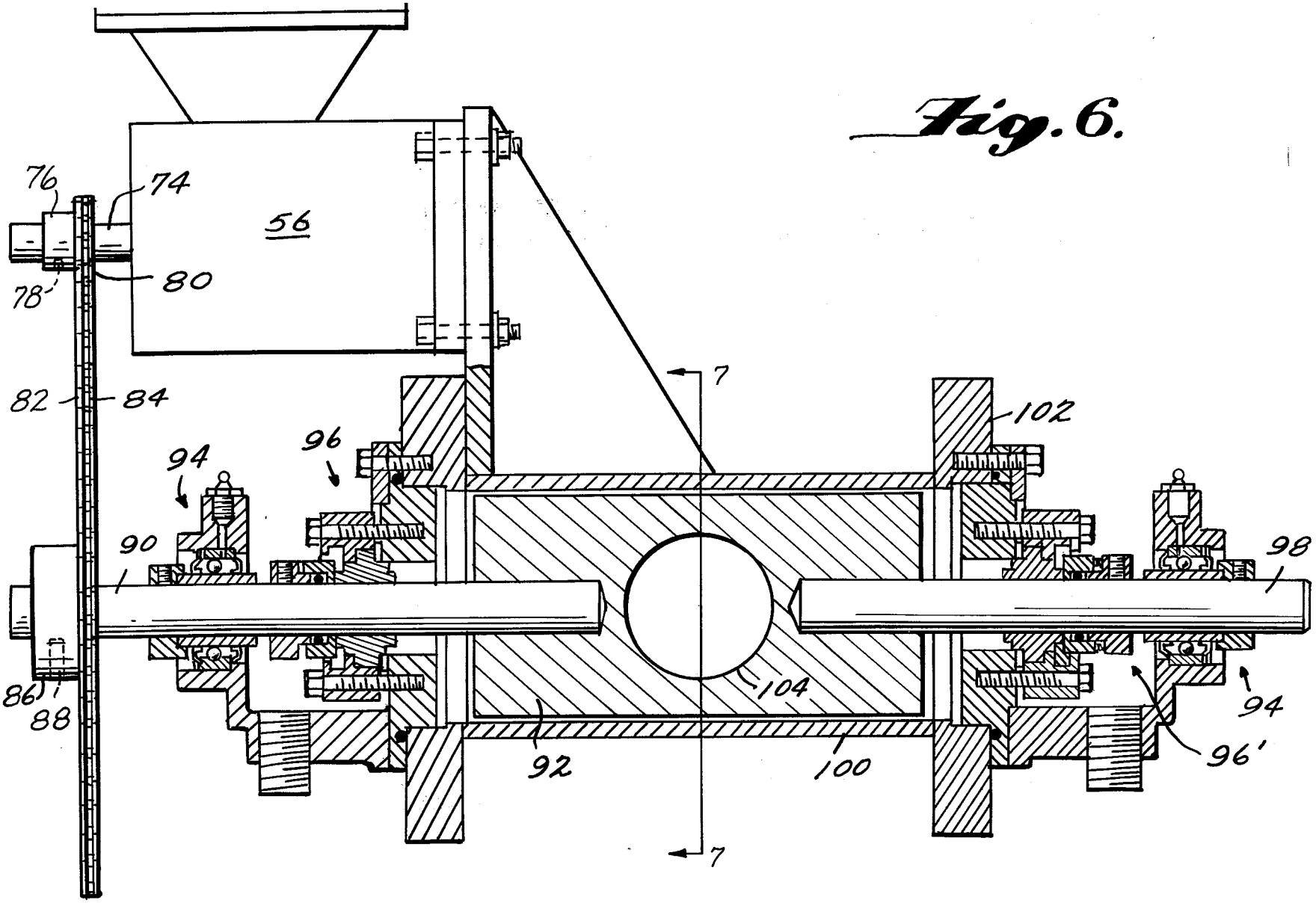

FIG. 4*a* shows a front view of the perforated inner kier wall;

FIG. 4*b* shows an alternative arrangement for the perforated inner kier wall;

FIG. 5 shows a detailed cross-sectional view of the doffing jet and the outlet port of the cloth guide tube into the kier;

FIG. 6 shows a cross-sectional view of the oscillating valve taken along lines 6–6 of FIG. 3; and FIG. 7 shows a partial cross section taken along the lines 7—7 of FIG. 6.

Figure 1:
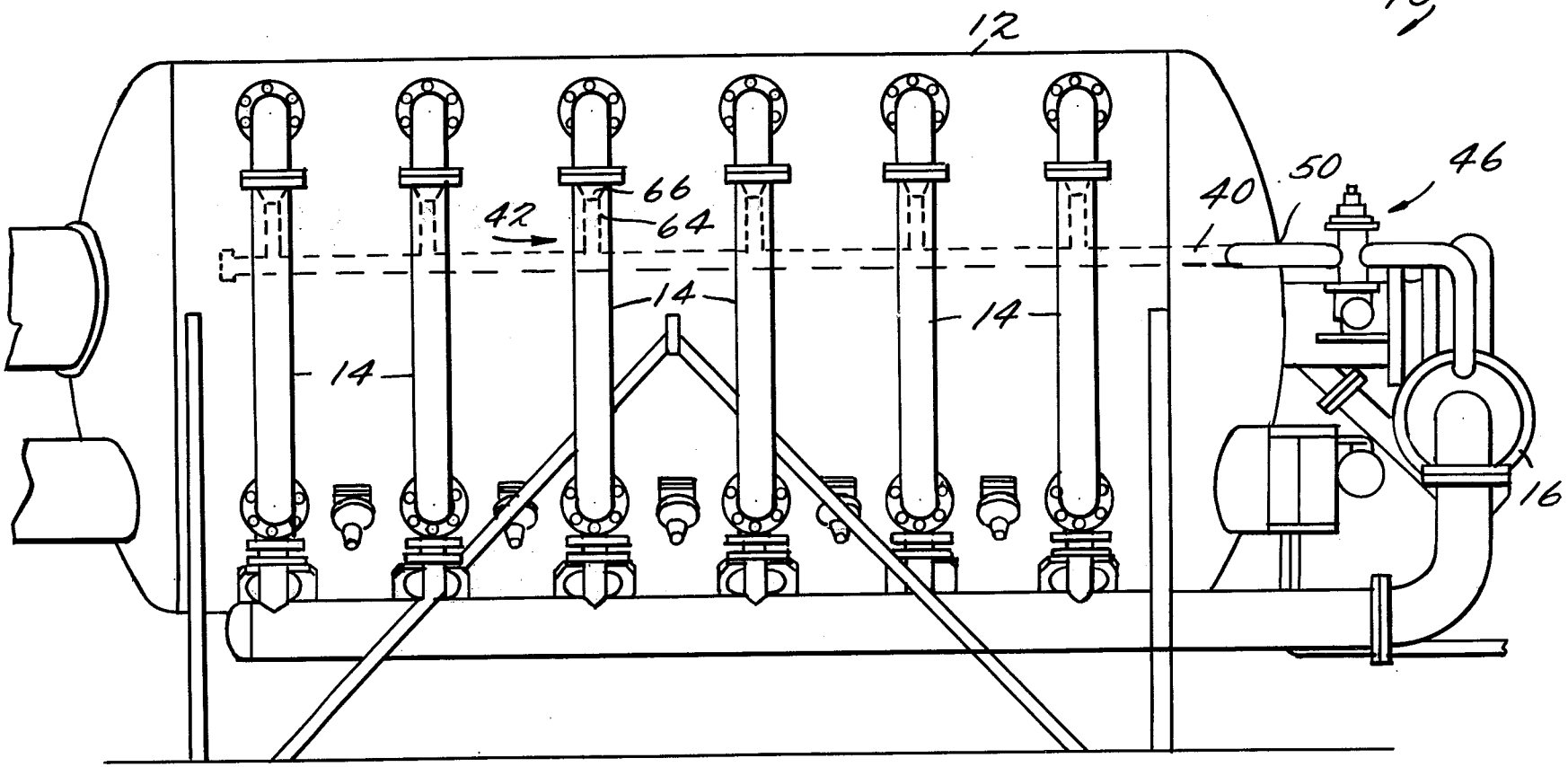
FIG. 1 shows a top view of a jet dyeing machineand the location of the doffing jets.

FIG. 1 shows a top view of a jet dyeing machine 10 and specifically the placement of the doffing jets 42. As shown, at least one doffing jet 42 is provided for each cloth guide tube across the width of the jet dyeing machine 10. The water line 40 which supplies doffing jets 42 with liquid to power the jets runs the full length of the machine 10 and enters the side wall of the machine at 50, after exiting the oscillating valve 46. In addition, the water line 40 extends between the oscillating valve 46 and heat exchanger 16.

Figure 2:
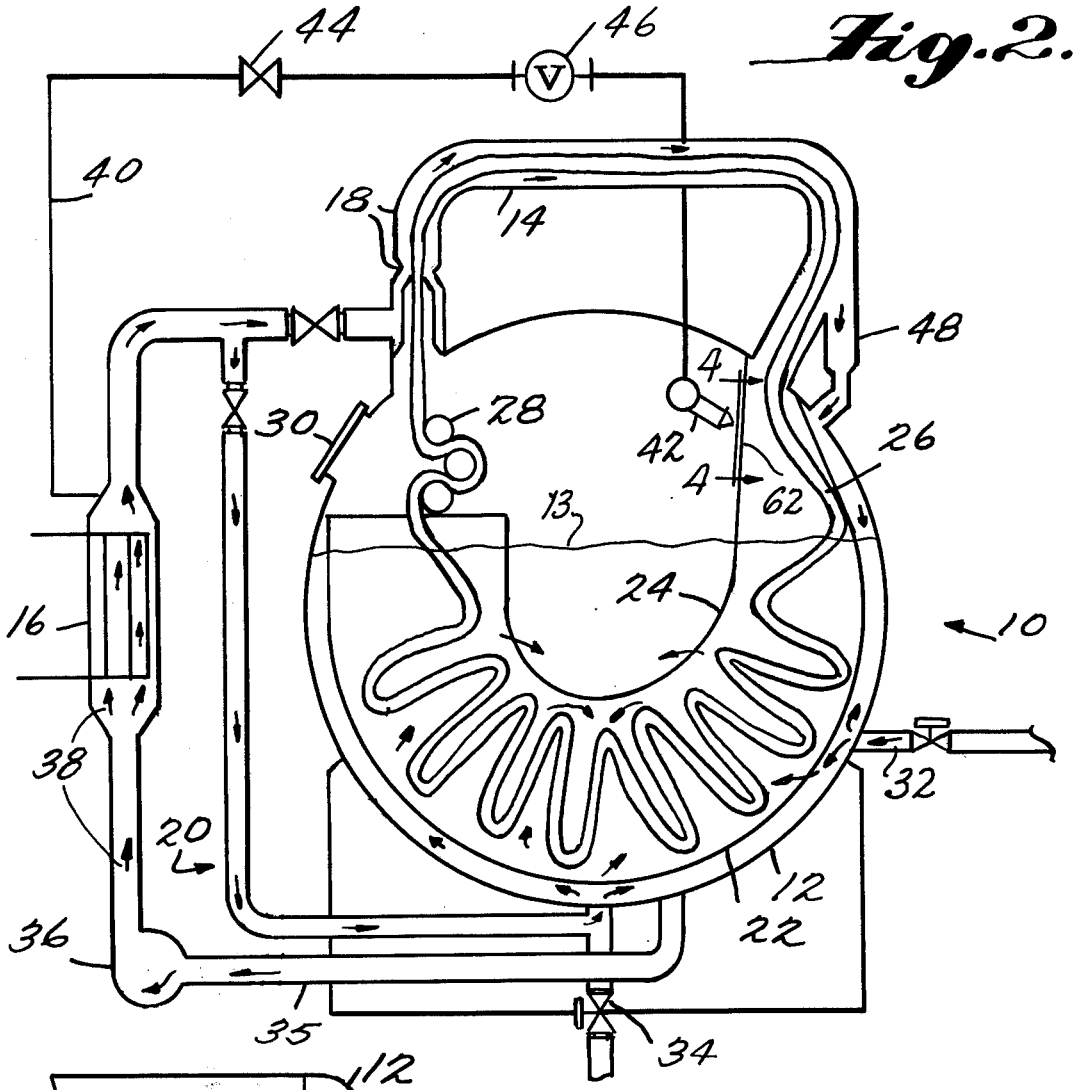
FIG. 2 shows a cross section of a jet dyeing machine.

FIG. 2 shows a schematic view of a jet dyeing machine 10, which consists of a kier 12, a cloth guide tube 14, a heat exchanger 16, the jet 18, and other piping and conduits generally indicated at 20.

Referring more specifically to the kier 12, dye liquor 13 is drained through a perforated sheet 22 located along the bottom of the kier 12. The perforated sheet 22 also forms the bottom of the J-box 24 in which the cloth 26 is stored or held just prior to and following its passing through the jet 18. As is clearly evident from FIG. 2, the fabric 26 is ideally placed in the J-box 24 in a folded or plaited fashion so that the cloth will be in position to be uniformly withdrawn at the forward end of the J-box 24 adjacent jet 18 without the creation of tangles. Likewise, it is advantageous to place the fabric 26 in the J-box 24 in a folded fashion since by doing so will allow more material to be placed in the jet dyeing machine than would otherwise be possible if the cloth were not folded uniformly.

The kier 12 is also provided with an optional cloth speed controller and/or braking device 28, a loading portion 30, and water-recirculation and drain conduits 32 and 34, respectively.

A centrifugal pump 36 is located in the water recycle line 35 between the outlet in the side of the kier 12 and the heat exchanger 16. Pump 36 provides the necessary force to recycle the dye liquor 13 shown by the arrows 38.

A water line 40 is attached to the outlet side of heat exchanger 16 and is connected to the doffing jet 42. A doffing jet throttle valve 44 is located in line 40, which is a 3-inch pipe, as is an oscillating valve 46, with the throttle valve 44 and oscillating valve 46 together controlling the operation of doffing jet 42.

As more clearly shown in FIG. 3, pipe 40 extends from the outlet side of the exchanger 16 to the jet dyeing machine 10 and enters the side wall of the kier 12 where it is suitably attached as by welding at 50. The throttle valve 44 is located in line 40 between the heat exchanger and the oscillating valve 46 which, itself, is secured to line 40 within a separate pipe section by means of flange joints 52 and 54, respectively.

Also shown in FIG. 3 is the drive motor 56 for rotating the oscillating valve 46.

The cloth 26 after being pulled out of the J-box 24 will pass through the braking device 28 and then through jet 18 by the venturi effect occurring within jet 18. After the cloth 26 has passed through the jet 18, it passes through the cloth guide tube 14 and will be returned to the opposite side of the kier 12 along with the dye liquor 13 that has been used to power the jet 18.

Just prior to the point at which the dye liquor 13 and cloth 26 re-enter kier 12, a diversion elbow 48 is provided to divert the flow of a portion of the dye liquor 13 that has been passed through the jet and has helped to carry the fabric 26 through the cloth guide tube 14. In this way, the amount of dye liquor 13 that actually passes directly back into the kier along with fabric 26 is substantially reduced.

FIG. 4*a* is a sectional view along the lines 4—4 in FIG. 2 and shows a portion of the upper part of the J-box wall 58. The J-box wall 58 is perforated and has a large number of randomly placed perforations 60 which allow dye liquor 13 within kier 12 to move freely through the kier and thus maintain the fabric 26 submerged in dye liquor during its passage through the J-box.

Across the upper rear portion of wall 58, a plurality of uniformly placed perforations 63 are provided so as to produce slit 62 which extends across wall 58.

Slit 62 is preferably about 3 inches in width and ½ inch high. The perforations 63 are about 3/32 inch in diameter and are spaced apart a distance which is about ⅜ inch between centers. In the preferred embodiment, slit 62 is located about 13 inches below the top of the jet dyeing machine 10. As an alternative embodiment shows in FIG. 4*b*, mini-slits 67 can be formed by removing every other partition between the regularly spaced perforations 63 as shown at 65 with mini-slits 67 being substantially 3/16 inch high by 9/16 inch long.

It is to be understood that the fabric storage side of perfoated wall 58 is polished so as to be smooth, thus assuring the fabric 26 will not become snagged on any of the perforations.

As shown in FIG. 5, slit 62 is aligned with the axis of doffing jet 42 so that liquid discharged from doffing jet 42 will pass through slit 62 prior to coming into contact with fabric 26. The jets 42 are attached, such as by welding, to the pipe 40 which runs transversely of the kier 12 and has a plurality of doffing jets 42 connected thereto. One doffing jet is provided for each cloth guide tube 14 and each J-box 24. In addition, each doffing jet 42 is angled downwardly from pipe 40 at an angle 43 of about 25° to 40° below horizontal and preferably at an angle of about 30°.

Each of the doffing jets 42 consists of a body section 64, the end of which is tapered into a nozzle 66. In the preferred embodiment, each doffing jet 42 is positioned inwardly of of the J-box wall 58 so that the nozzle 66 is positioned about one-half inch to an inch away from wall 58, with a relatively flat or rectangular shaped nozzle opening. As indicated above, the axis of the doffing jet 42 is aligned with the slit 62 within the J-box wall 58. Because the doffing jet nozzle 66 is spaced inwardly from wall 58, the relatively flat stream of dye liquor 68 discharged from nozzle 66 will first contact slit 62 in wall 58 which serves to maintain a substantially rectangular cross section for stream 68. Thus, stream 68 contacts fabric 26 at 70 in the form of a flat band. The pressure of the dye liquor as it is passing through the nozzle 66 will be about 40 pounds per square inch which is sufficient to force fabric 26, normally directed toward J-box wall 58 by the cloth guide tube 14, toward the rear of kier 12 or toward wall 72.

The stream 68 of dye liquor flowing from the doffing jet 42 is operated intermittently through the action of oscillating valve 46 so that the fabric which is initially directed toward wall 58 is only intermittently forced toward wall 72. As the stream 68 is pulsated on and off, a forward and backward motion is thereby imparted to fabric 26 which becomes plaited or folded as it enters the upper rear portion of J-box 24. The fabric 26 is shown in FIG. 2 in a folded or plaited condition generally at 27.

The doffing jet 42 is preferably constructed from stainless steel and the opening forming nozzle 66 of doffing jet 42 is about ⅛ inch high and 2¾ inch wide.

Applicant found that in order to effectively plait the fabric 26, the pulse rate for the doffing jet 42 should be in the range of about 40 pulses per minute to about 60 pulses per minute. When dealing with light-weight fabrics, a pulse rate substantially lower than 40 pulses per minute allowed the fabric to build up on one side of the upper portion of the J-box 24 with the fabric finally falling over on itself. When this occurred, cloth tangles were created when that section of fabric appeared below the jet 18 since fabric had to be pulled out from under the fabric which had fallen over on itself.

Pulse rates too far in excess of 60 pulses per minute tend to force the cloth to travel in a straight line down away from the exit of cloth guide tube 14 and likewise resulted in cloth buildups on one side of the kier with those buildups falling over, which likewise created tangle problems.

In order to achieve level dyeings it is important that the fabric 26 revolves around the jet dyeing machine 10 at an even rate. When the fabric 26 is falling over on itself, there is tension applied to the fabric as it is pulled out under the resulting pile upon arriving at the front of the kier 12 where jet 18 will pull the fabric 26 out of the kier 12. This added tension results in very uneven flow and thus affects the cloth speed as it goes through the jet 18. When the cloth has not fallen over on itself, this tension does not exist so that fabric 26 is easily removed from the J-box in jet 18 at a much more even rate. This not only allows the dyeing to be very uniform which produces uniform and even shades and level dyeing but also allows for faster operating speeds. Applicant found that by using the pulsating doffing jet 42 as indicated herein, the fabric speed for light-weight cloth varied from 190 to 210 yds,./min., while without using the pulsating doffing jet, the fabric speed for the same cloth varied from 150 to 250 yds./min. As indicated above, such variation in cloth speed results in uneven dyeing. Also, when the fabric is piled on top of itself, there is a higher tendency of having wrinkles, creases and tangles formed by the extra weight on the fabric while unevenly piled.

Prior to installing the pulsating doffing jet, the applicant found that when dyeing a 45 inch wide woven textured polyester crepe fabric of 16.7 pounds per 100 yards, only approximately 400 yards per tube could be processed with a dye time of approximately 15 hours at an average fabric speed of about 120 yds./min. In addition, the fabric was constantly tangling and the quality was unsatisfactory due to unlevel dyeing as a result of this tangling.

Subsequent to installing the doffing jet, applicant found that lengths of the same light-weight fabric could be more than doubled and in fact, were as long as 1,000 yards per tube. In addition, the average fabric speed has been increased and more importantly, held within a narrower variation range at about 200 yds./min. As a consequence, the dye cycle time has been decreased while the amount of fabric being treated has more than doubled. Further, as fabric speed is increased, less time is required to heat and cool the treating liquid, such as dye liquor, which allows a like reduction in the total dye cycle. For example, 1,000 yards of the same 45 inch wide woven textured polyester crepe fabric weighing 16.7 pounds per 100 yards was dyed at an average rate of 200 yds,./min. in 11 hours with the pulserate for the doffing jet being about 52 pulses/min.

As a further benefit flowing from the present invention, applicant has discovered that use of the doffing jet as described herein has allowed the fabric rate to be slowed from the increased maximum and yet still be faster than was previously the case. As a consequence, the slowing of the fabric circulation rate and the narrowing of the rate fluctuations has provided a more constant fabric circulation throughout the dye cycle thereby resulting in more level dyeings Turning now to FIG. 6, there is shown a cross-sectional view of oscillating valve 46 as taken along the line 6—6 in FIG. 3.

Connected to motor 56, a three-quarter horse power D.C. motor capable of 1750 revolutions per minute, is a drive shaft 74 having a sprocket 76 secured thereon by means of set screw 78. Connected to sprocket 76 is an extended flange 80 adapted to engage a belt or drive chain 82. Belt 82 is adapted to engage flange 84 on sprocket 86 which is secured to shaft 90 by means of set screw 88.

Shaft 90 is the main driving shaft for oscillating valve 46 and is connected to the interior oscillating member 92 of valve 46 by welding or any other suitable means.

As is shown, shaft 90 extends from sprocket 86 through bearing and sealing means 94 and 96, respectively, on one side of the valve. Shaft 98 supports the other side of the valve and likewise extends through identical bearing and sealing means as shown at 94' and 96'.

Since bearings 94 and 94' and sealing members 96 and 96' are of a conventional type and do not specifically form a part of this invention, further discussion herein is not considered to be required. It is essential only that seals 96 and 96' adequately prevent leakage of water out of the chamber containing the rotating member 92 along the shafts 90 or 98 and that the bearings 94 and 94' support shafts 90 and 98 allow those shafts to rotate freely.

The oscillating valve 46 comprises an outer housing 100 having end walls 102 designed so as to receive the sealing devices 96 and 96'.

Located within housing 100 is the rotating member 92 which is provided with a single cylindrical opening 104 provided in the central portion of rotating member 92. The pipe 40 is connected to opposite sides of housing 100 so that the treating liquid, under pressure due to the effect of the circulation pump 36 will flow through oscillating valve 46 when the cylindrical opening 104 is aligned therewith.

As shown in FIG. 7, the cylindrical opening 104 will be intermittently aligned with pipe 40 and thus during such periods as that alignment occurs, allow dye liquor to flow from the heat exchanger through the cylindrical opening 104 and oscillating valve 46, and into the doffing jets 42.

The rotating member 92, shafts 90 and 98 and the housing 100 are all preferably made from stainless steel. It should be understood, however, that other materials could be used depending on the liquid being used to treat fabric within the jet dyeing machine.

The housing 100 is preferably about 4 inches in diameter and about 8 inches long while the rotating member is about 3.8 inches in diameter and 7.5 inches long. The opening 104 is about 2.5 inches in diameter and pulse rates of about 40 pulses/min. to about 60 pulses/min. can be obtained from motor speeds of 800 rpm to 1200 rpm, when the ratio of the size of flange 80 to flange 84 is 40:1. Applicant found that for proper plaiting, the pulsation rate must be in direct proportion to the fabric speed. Thus, when the fabric speed is 150 yds,./min., the pulsation rate is about 52 pulses/min. while at a fabric speed of 200 yds./min. the pulsation rate will be 60 pulses/min.

Thus, applicant has described in detail an improved process for handling light-weight textile fabrics in jet dyeing machines. However, those skilled in the art may recognize embodiments other than as set forth herein without departing from the substance, spirit or advantages of this invention. Accordingly, all such embodiments are intended to be included within the scope of this invention, which scope is defined solely by the appended claims.

What is claimed is:

1. A jet dyeing machine for treating textiles with treating liquids having a kier, a jet, a cloth guide tube, means for forming a treating liquid circulation path for withdrawing treating liquid from said kier and supplying treating liquid to said jet and including a circulation pump and heat exchanger located in the circulation path for thetreating liquid, wall means defining at least one fabric storage area having an entrance portion and an exit portion and at least one doffing jet having a nozzle, means for supplying liquid to said doffing jet so as to power said doffing jet the improvement comprising:

slot means for channeling liquid discharged from said doffing jet, said slot means being positioned adjacent said entrance portion of the fabric storage area;

said doffing jet having an axis being positioned inwardly of said wall means defining said fabric storage area and aligned with said slot means, the axis of said doffing jet being at an angle ranging between about 25° to about 40° down from horizontal; and oscillating valve means for causing the doffing jet to operate intermittently, said oscillating valve means being positioned in the treating liquid circulation path between said doffing jet and said heat exchanger.

2. A jet dyeing machine as claimed in claim 1 wherein the said doffing jet axis is angled 30° down from horizontal.

3. A jet dyeing machine as claimed in claim 2 wherein the doffing jet nozzle has a substantially rectangularly shaped cross section.

4. A jet dyeing machine as claimed in claim 3 wherein said nozzle is about ⅛ inch high by about 2¾ inches wide, said nozzle being positioned about ½ inch from said slot means.

5. A jet dyeing machine as claimed in claim 2 wherein said slot means is formed with a plurality of uniformly spaced perforations each having a diameter substantially equal to the distance between adjacent perforations.

6. A jet dyeing machine as claimed in claim 5 wherein the diameter is about 3/32 of an inch.

7. A jet dyeing machine as claimed in claim 2 wherein said slot means is formed from a plurality of mini-slits wherein the width of said mini-slits is about three times the height of said mini-slits.

8. A jet dyeing machine as claimed in claim 7 wherein the distance between said mini-slits is equal to the height of said mini-slits and said height is about 3/32 of an inch.

9. A jet dyeing machine as claimed in claim 8 wherein said oscillating valve comprises stainless steel and said cylindrical opening has a diameter of 2½ inches.

10. A jet dyeing machine for treating textile material with treating liquids and having a kier for holding treating liquid and a quantity of the textile material being treated, a cloth guide tube connected to the kier so as to form therewith an endless circulation path for the textile material, jet means located within said cloth guide tube for at least assisting in circulating the textile material through the circulation path formed by the kier and the cloth guide tube, treating liquid circulation means for withdrawing treating liquid from the kier and directing the withdrawn treating liquid to said jet means to power said jet means, a heat exchanger through which the withdrawn treating liquid is directed, wall means defining at least one textile material storage area within said kier, said storage area having an entrance and exit portion, at least one doffing jet located adjacent the entrance portion of said storage area for assisting in plaiting the textile material leaving the cloth guide tube, means for supplying liquid to power said doffing jet, said wall means includes a least a first wall toward which at least a portion of the textile material is plaited, slot means for channeling liquid discharged from said doffing jet, said slot means being positioned in said first wall adjacent the entrance to said storage area, said doffing jet being positioned on the opposite side of said first wall from that forming the storage area into which textile material is deposited, said doffing jet having an axis which is aligned with said slot means, the axis of said doffing jet being directed downwardly toward said slot means at an angle ranging between about 25° to about 40° from a line perpendicular to said first wall and said means for supplying liquid to said doffing jet includes oscillating valve means for causing the doffing jet to operate intermittently.

11. A jet dyeing machine as in claim 10 wherein said means for supplying liquid to said doffing jet includes conduit means for forming a liquid circulation path between said treating liquid circulation means and said doffing jet.

12. A jet dyeing machine as claimed in claim 11 wherein said oscillating valve means comprises an outer housing, a rotatable valve member rotatably secured within said outer housing, drive means for rotating said rotatable valve member and sealing means for sealing said rotatable valve within said oscillating valve means wherein said rotatable valve member has a single cylindrical opening provided therein, said conduit means being connected to opposite sides of said outer housng so that the liquid will flow to said doffing jet when said cylindrical opening is aligned with said conduit means.

13. A jet dyeing machine as claimed in claim 11 wherein said oscillating valve means comprises an outer housing, a rotatable valve member rotatably secured within said outer housing, drive means for rotating said rotatable valve member and sealing means for sealing said rotatable valve within said oscillating valve wherein said rotatable valve member includes means defining a passageway extending through said rotatable valve member for allowing liquid to pass therethrough, said conduit means being connected to said outer housing in such a manner that as said rotatable valve member is rotated within said outer housing said passageway will be intermittently aligned with said conduit means so that liquid will intermittently flow through said valve means to said doffing jet.

14. A jet dyeing machine for treating textile materials substantially in rope form comprising means defining a closed vessel providing an endless path for circulating a length of textile material through the treating liquid about a generally horizontal axis, said vessel including a textile material storage area within said circulation path for the textile material and through which the textile material will pass, said storage area having an entrance portion and an exit portion, means for circulating the textile material within said vessel means around said textile material circulation path so that the textile material is removed from the exit portion of the storage area and returned to the entrance portion of the storage area, heating means for heating the treating liquid to a predetermined temperature, at least one doffing jet located at the entrance portion of said storage area, means for supplying liquid to said doffing jet for purposes of plaiting textile material entering said storage area, said storage area being comprised of wall means for retaining the textile material within said storage area, said wall means including a first wall positioned between said textile material retained in said storage area and said doffing jet, said first wall further including means defining a slot axially aligned with said doffing jet for channeling liquid discharged by said doffing jet into a substantially flat stream so as to impinge transversely across at least a portion of the textile material returned to said storage area, said doffing jet having an axis aligned with means defining said slot and directed at an angle ranging from between about 25° to about 40° downwardly toward said means defining said slot from a plane perpendicular to said first wall.

* * * * *